US006478067B1

(12) United States Patent
Huang

(10) Patent No.: US 6,478,067 B1
(45) Date of Patent: Nov. 12, 2002

(54) ADHESIVE TAPE DISPENSER PROVIDED WITH CUTTER FOR CUTTING TAPE, AND THE LIKE OF A PACKAGE TO FACILITATE THE UNPACKING OF THE PACKAGE

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 60 days.

(21) Appl. No.: 09/662,152

(22) Filed: Sep. 14, 2000

(51) Int. Cl.[7] ..... B32B 31/00

(52) U.S. Cl. ..... 156/511; 156/523; 156/527; 156/574; 156/577; 156/579

(58) Field of Search ..... 156/511, 523, 156/527, 530, 574, 577, 579; 30/2; 7/158, 160; 206/225, 226, 228, 229, 230

(56) References Cited

U.S. PATENT DOCUMENTS 5,062,173 A * 11/1991 Collins et al. ..... 30/255
5,117,524 A * 6/1992 Chang ..... 30/123
5,549,255 A * 8/1996 Huang ..... 156/579
5,613,300 A * 3/1997 Schmidt ..... 30/125
5,769,497 A * 6/1998 Tsai ..... 297/411.36
6,047,882 A * 4/2000 Sin et al. ..... 229/125.32

* cited by examiner

*Primary Examiner*—Richard Crispino
*Assistant Examiner*—Cheryl N. Hawkins
(74) *Attorney, Agent, or Firm*—Browdy and Neimark, P.L.L.C.

(57) ABSTRACT

An adhesive tape dispenser comprises a grip on which a base board is mounted. A rotary seat is mounted pivotally on the base board and is provided with a dispensing cutter. A roller is pivoted to the base board and is located under the dispensing cutter. The base body is provided with a concealable unpacking cutter to facilitate the unpacking of a package.

12 Claims, 8 Drawing Sheets

ADHESIVE TAPE DISPENSER PROVIDED WITH CUTTER FOR CUTTING TAPE, AND THE LIKE OF A PACKAGE TO FACILITATE THE UNPACKING OF THE PACKAGE

FIELD OF THE INVENTION

The present invention relates generally to an adhesive tape dispenser, and more particularly to an adhesive tape dispenser which is provided with means to cut the tape, cord, and the like of a package to facilitate the unpacking of the package.

BACKGROUND OF THE INVENTION

The conventional adhesive tape dispenser is often used in the packaging; nevertheless it is not provided with means to cut the adhesive tape, cord, and the like of a package to facilitate the unpacking of the package.

SUMMARY OF THE INVENTION

The primary objective of the present invention is to provide an adhesive tape dispenser with a concealable cutter for use in the unpacking of a package.

The adhesive tape dispenser of the present invention comprises a grip, and a base board which is mounted on the top end of the grip and is provided in the rear end with a rotary seat for mounting an adhesive tape roll, and in the front end with a base body. A tape dispensing cutter is mounted on the base body. A roller is pivoted to the base board such that the roller is located under the tape dispensing cutter. The base body is provided at the outer end with a movable and concealable unpacking cutter for use in cutting tape, cord, and the like of a package so as to facilitate the unpacking of the package.

DETAILED DESCRIPTION OF THE INVENTION

Figure 1:
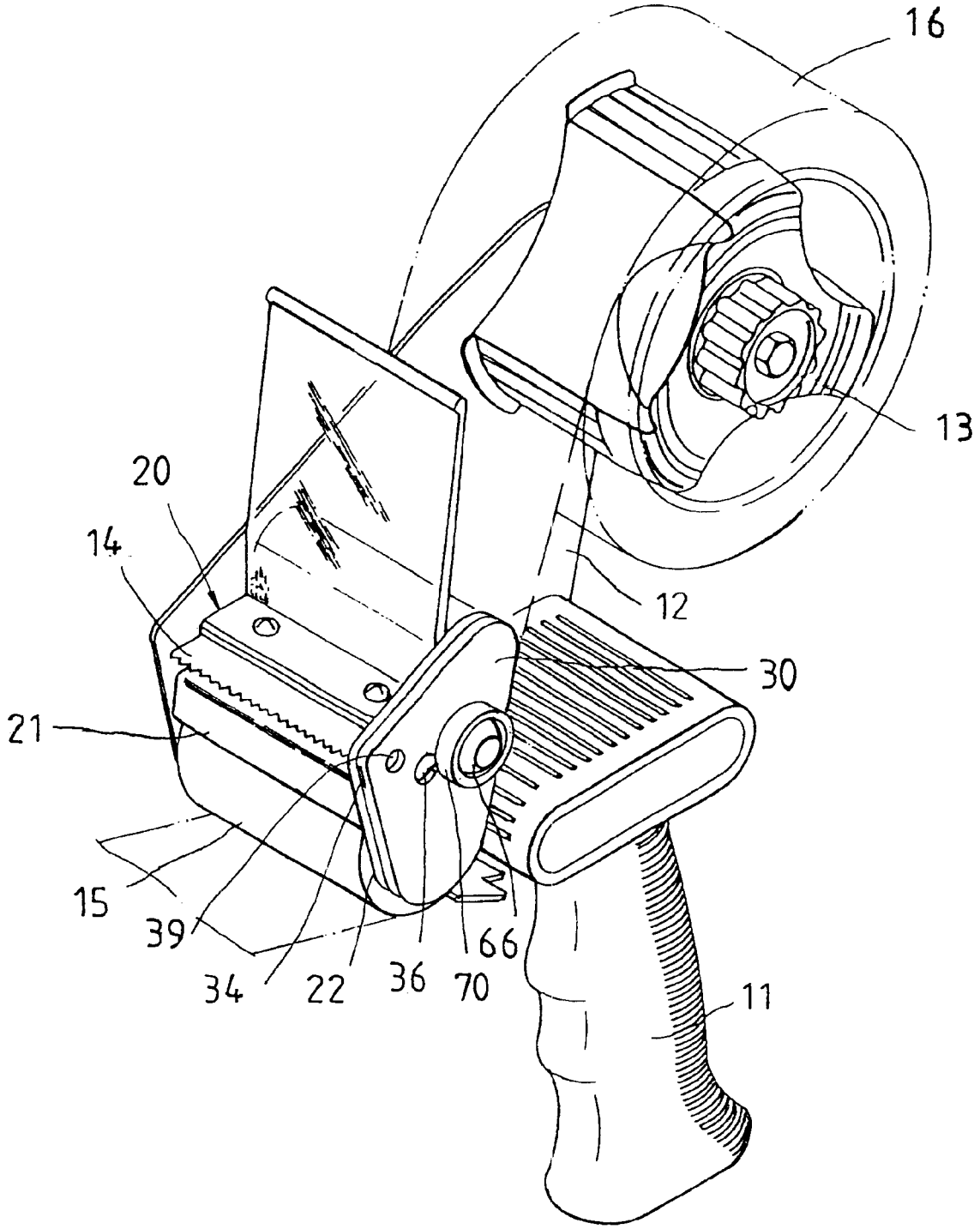
FIG. 1 shows a perspective view of a preferred embodiment of the present invention.

As shown in FIG. 1, an adhesive tape dispenser of the preferred embodiment of the present invention comprises a grip 11, a base board 12 mounted on the top end of the grip 11, a rotary seat 13 pivoted to the base board 12, a base body 20 fastened to the base board 12 such that the base body 20 is opposite to the rotary seat 13 and is provided with a cross portion 21 having a side plate portion 22 parallel to the base board 12, a dispensing cutter 14 mounted on the cross portion 21, and a roller 15 pivoted between the base board 12 and the side plate portion 22 such that the roller 15 is located under the cross portion 21. The rotary seat 13 is used to mount an adhesive tape roller 16.

Figure 2:
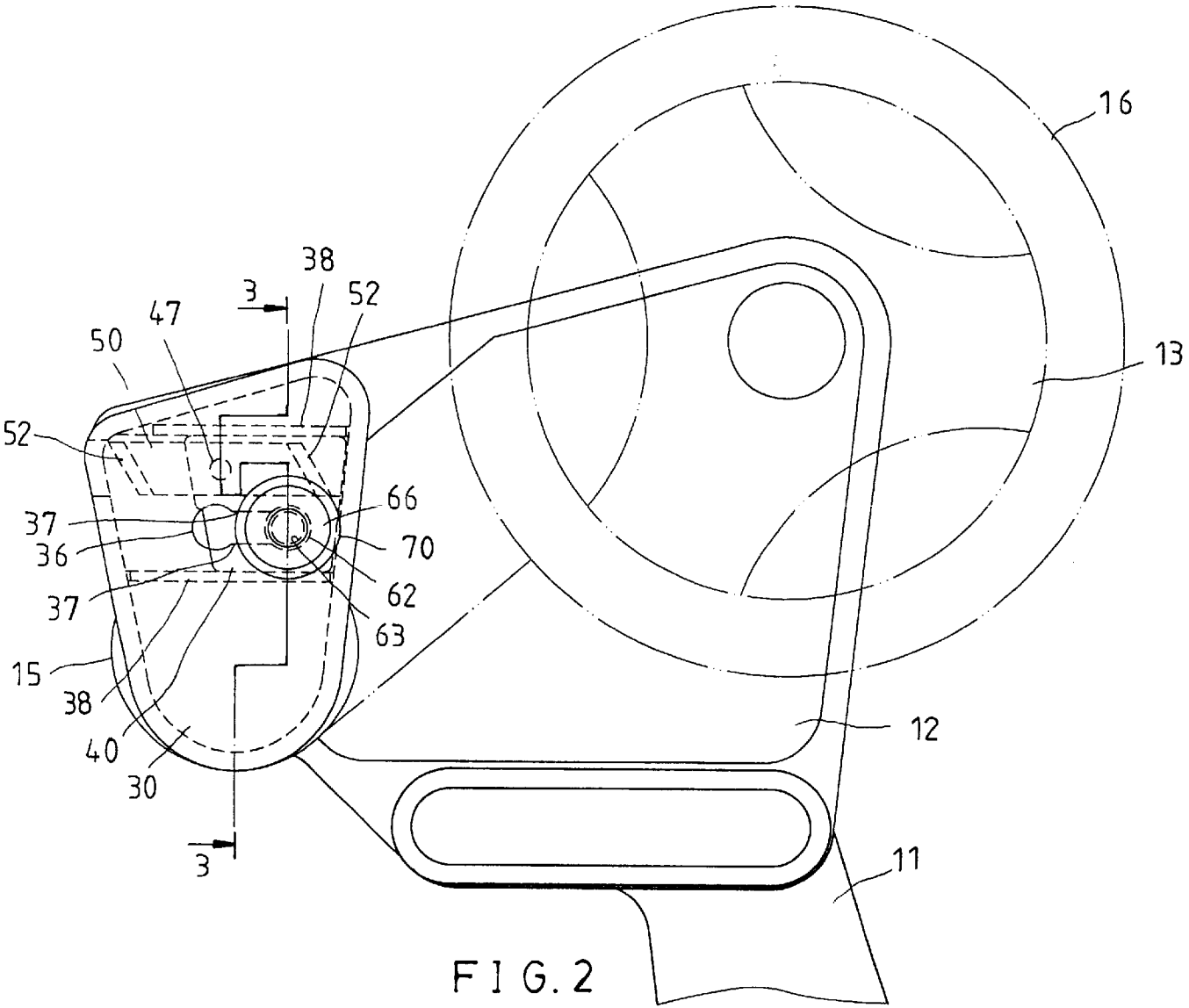
FIG. 2 is a side view of the preferred embodiment of the present invention showing that the unpacking cutter is concealed.
Figure 3:
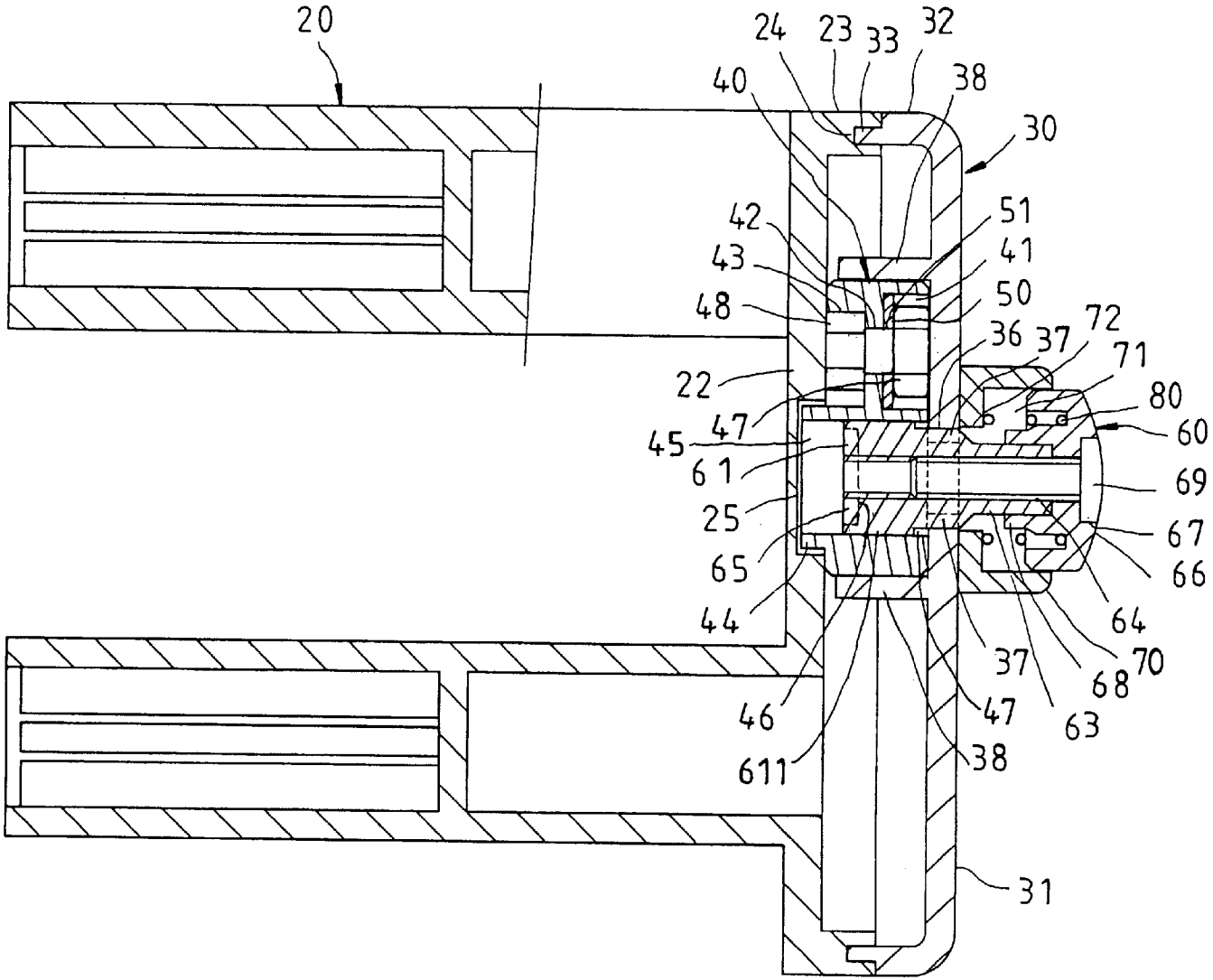
FIG. 3 is a sectional view taken along the direction of a line 3—3 in FIG. 2 to show that a control member is extracted.
Figure 4:
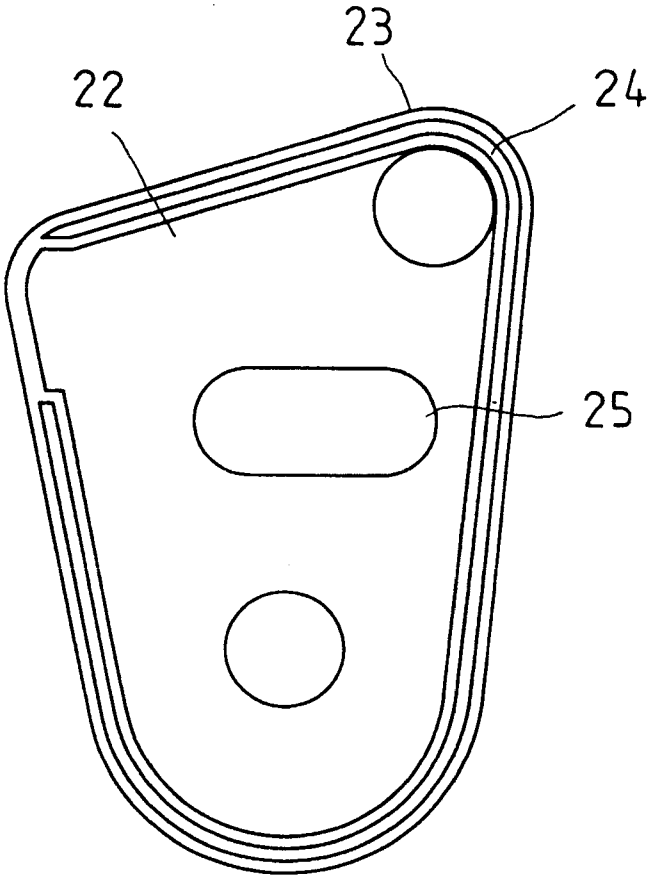
FIG. 4 shows a schematic plan view of the base body of the preferred embodiment of the present invention.

As shown in FIGS. 2 and 3, the side plate portion 22 of the base body 20 is provided with an annular wall 23 having an insertion slot 24. The insertion slot 24 is not extended in a full circle, as shown in FIG. 4. The side plate portion 22 is provided in proximity of the center thereof with a slide slot 25.

Figure 5:
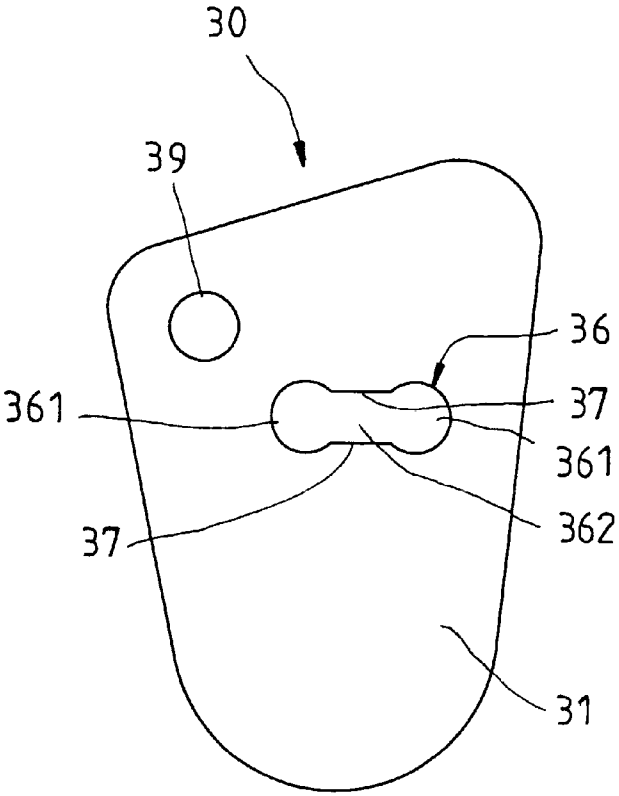
FIGS. 5–7 are respectively a front view, an inner view, and a side view of a cover of the preferred embodiment of the present invention.
Figure 7:
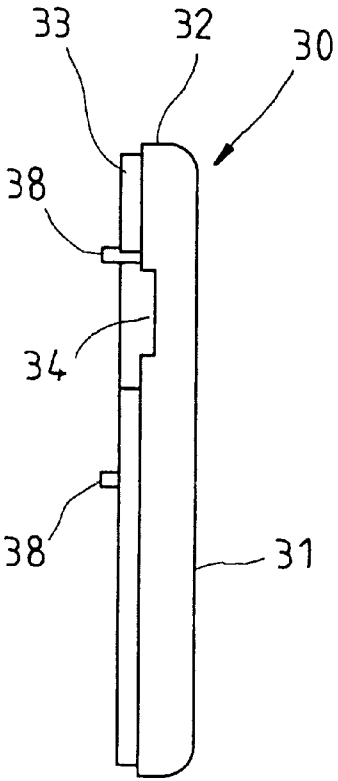
Figure 6:
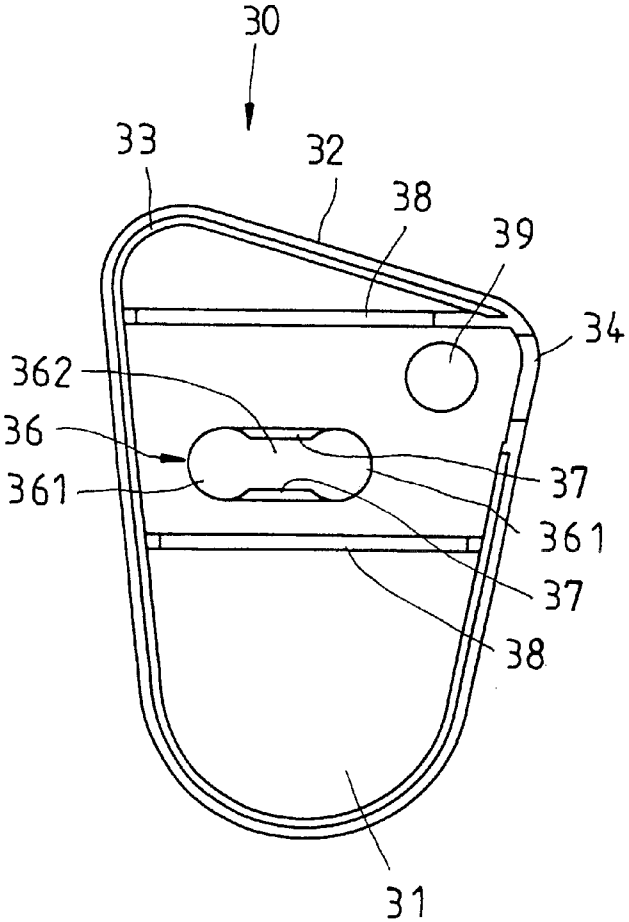

As shown in FIGS. 5–7, a cover 30 is corresponding in shape to a main plate 31 of the side plate portion 22. The main plate 31 is provided in the fringe of the inner side thereof with an annular edge 32 having an insertion strip 33 which is corresponding in location to the insertion slot 24 of the side plate portion 22. Like the insertion slot 24, the insertion strip 33 has a break portion. The annular edge 32 is provided with an exit 34 corresponding in location to the break portion. The cover 30 is adhered to the side plate portion 22 such that the insertion strip 33 is inserted into the insertion slot 24, and that a receiving cell 27 is formed between the cover 30 and the side plate portion 22. The main plate 31 is provided with a hole 36 corresponding in location to the slide slot 25 of the side plate portion 22 and having two stop portions 37 projecting toward the inside of the hole 36. The hole 36 is provided at both ends with a locating portion 361, and in the middle with a passage portion 362 smaller in longitudinal width than the locating portion 361. The hole 36 is further provided with two cross plates 38.

Figure 8:
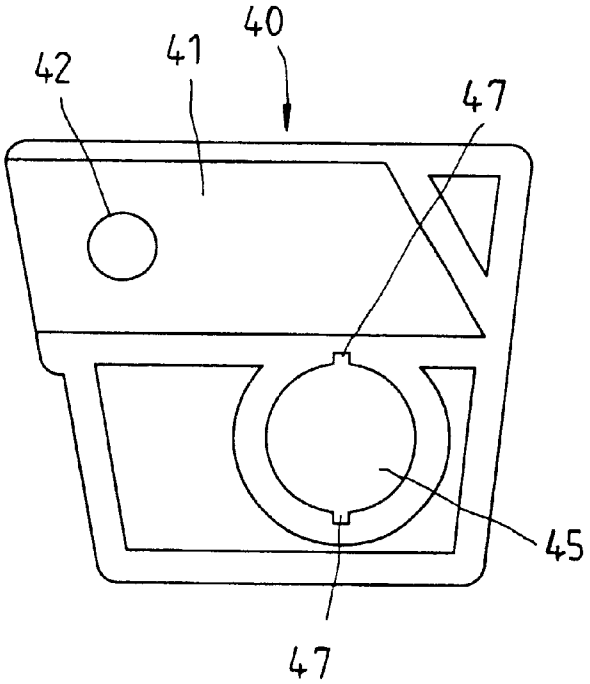
FIGS. 8 and 9 are front view and rear view of a cutter mount of the preferred embodiment of the present invention.
Figure 9:
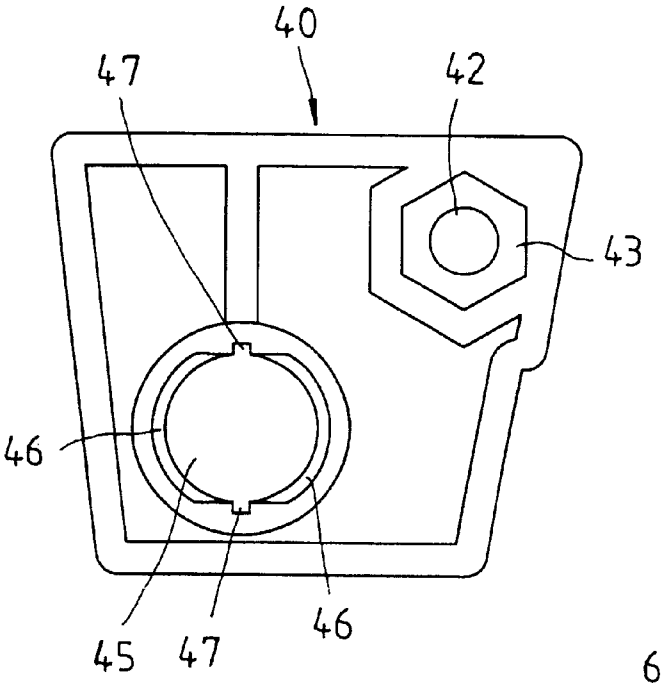

As shown in FIGS. 8 and 9, a cutter mount 40 of an inverted trapezoidal construction is provided with a cutter slot 41 having a through hole 42. The cutter mount 40 is further provided with a hexagonal nut slot 43 corresponding in location to the through hole 42, and a pillar 44 having a through hole 44 which is provided in the inner wall thereof with two arcuate shoulders 46 opposite to each other. Located between the two shoulders 46 are two grooves 47 extending axially. The cutter mount 40 is disposed in the receiving cell 27 such that two sides of the cutter mount 40 are in contact with the side plate portion 22 and the main plate 31 of the cover 30, and that two side edges are held by the two cross plates 38 of the cover 30, and further that the pillar 44 is inserted into the slide slot 25 of the side plate portion 22. The cutter mount 40 is slidable in the slide slot 25.

An unpacking cutter 50 is fastened in the cutter slot 41 by a fastening bolt 47 which is engaged with a nut 48 via the round hole 51 of the cutter 50 and the through hole 42 of the cutter mount 40. The nut 48 is disposed in the nut slot 43. The cutter 50 has a blade 52 projecting out of the front side of the cutter mount 40.

Figure 10:
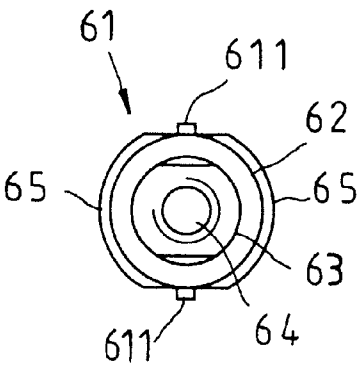
FIG. 10 shows a front view of a rod body of the preferred embodiment of the present invention.

As shown in FIGS. 3 and 10, a control member 60 comprises a rod body 61 and a press knob 66. The rod body 61 has a large diametrical portion 62 and a small diametrical portion 63. The large diametrical portion 62 is smaller in diameter than the circular locating portion 361 of the hole 36 of the cover 30, but greater than the longitudinal width of the passage portion 362. The small diametrical portion 63 has a diameter smaller than the longitudinal width of the passage portion. The rod body 61 is provided with a threaded axial hole 64 and is further provided in the periphery of the large diametrical portion 62 with two arcuate protruded edges 65 and two ribs 611. The rod body 61 is disposed in the through hole 45 of the cutter mount 40 and the hole 36 of the cover 30 such that the ribs 611 are received in the grooves 47, and that the rod body 61 is axially movable without being able to rotate, and further that the protruded edges 65 press against the shoulders 46 so as to secure the rod body 61 in place. The press knob 66 is provided with a fisheye hole 67 and a sleeve 68 which is fastened with the small diametrical portion 63 in conjunction with a screw 69 which is engaged with the threaded hole 64 via the fisheye hole 67.

A slide seat 70 is of a round construction and provided with a cavity 71 and a through hole 72. The slide seat 70 is disposed between the cover 30 and the press knob 66 such that its smooth side in contact with the main plate 31, and that the rod body 61 is put through the through hole 72 of the slide seat 70, and further that the press button 66 is received in the cavity 71.

An elastic member 80 of a coil spring construction is fitted over the sleeve 68 such that both ends of the spring 80 urge the press knob 66 and the slide seat 70, thereby forcing the control member 60 in an outward direction.

Figure 11:
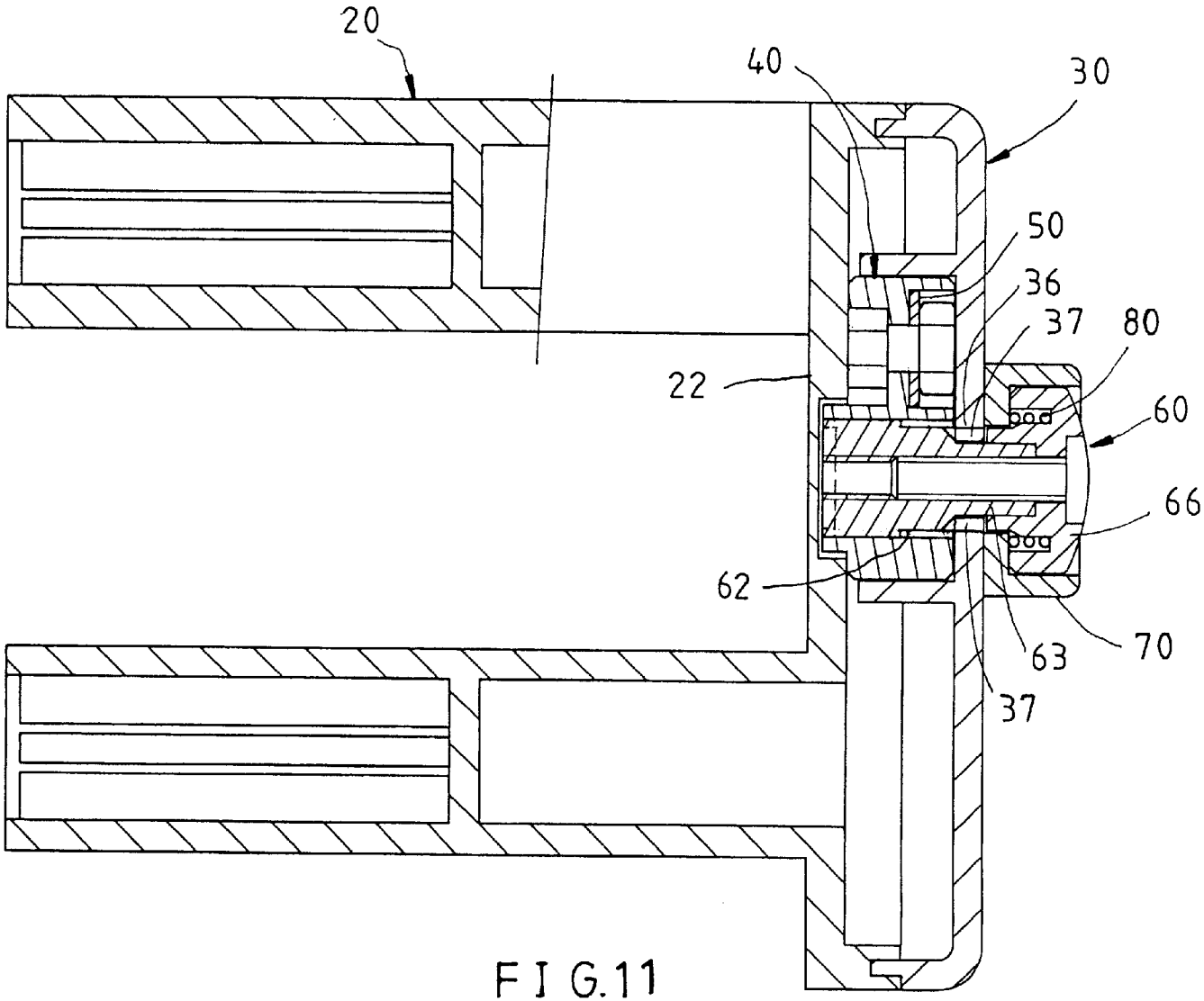
FIG. 11 is a schematic view showing that the control member of the preferred embodiment of the present invention is retracted.

As shown in FIG. 3, the control member 60 is urged by the spring 80 such that the protruded edge 65 is stopped by the shoulder 46, and that the outer end of the press knob 66 is jutted out of the slide seat 70, and that the large diametrical portion 62 is received in the hole 36. In light of the stop portion 37, the large diametrical portion 62 can be moved into the cover 30 when the press knob 66 is pressed to cause the control member 60 to displace axially, as shown in FIG. 11. In the meantime, the rod body 61 can be caused to displace along the hole 36 as long as the control member 60 is pressed. When the press knob 66 is let go at the front end or the rear end of the hole 36, the control member 60 is urged by the spring 80 to jut out to enable the rod body 61 to be retained in the locating portion 361 of the hole 36. As the control member 60 is moved along the hole 36, the slide seat 70 and the cutter mount 40 are forced by the rod body 61 to slide rearwards. As shown in FIG. 2, the rod body 61 is located at the rear end of the hole 36, the unpacking cutter 50 is retracted into the receiving cell 27. When the rod body 61 is located at the front end of the hole 36, as shown in FIG. 12, the unpacking cutter 50 is extracted from the receiving cell 27 via the exit 34 to be in a standby position.

Figure 12:
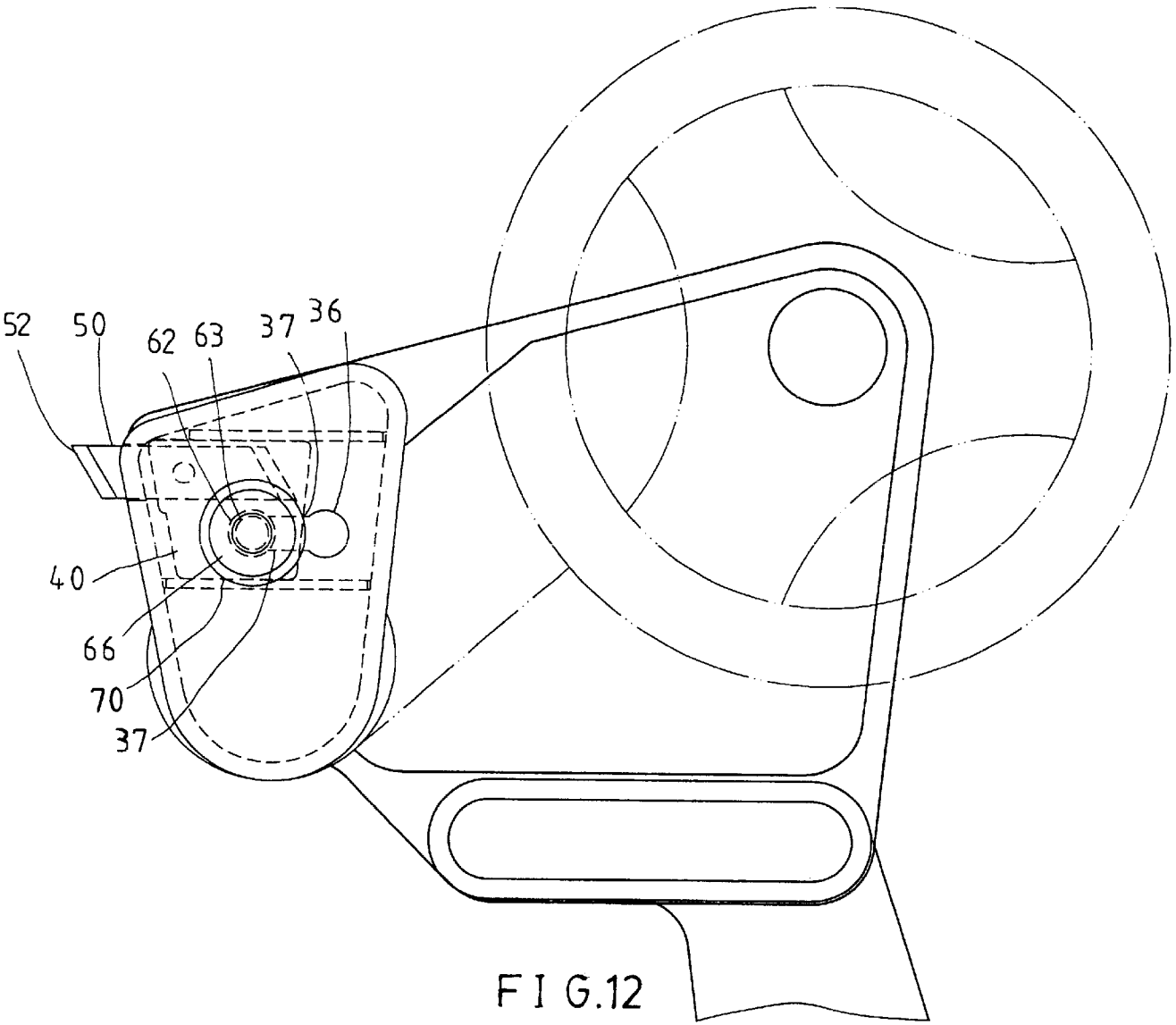
FIG. 12 is a schematic view showing that the unpacking cutter of the preferred embodiment of the present invention is located at the working position.

As shown in FIG. 12, when the unpacking cutter 50 is in the standby position, it is detachably fastened by a screw 47 which is received in a fastening hole 39 of the main plate 31 of the cover 30. The cutter 50 can be replaced by unfastening the screw 47.

What is claimed is:

1. An adhesive tape dispenser comprising:

a grip;

a base board mounted on a top end of said grip;

a rotary seat pivoted to said base board;

a base body fastened to said base board;

a dispensing cutter mounted on said base body; and a roller pivoted to said base board such that said roller is located under said dispensing cutter;

wherein said base body is provided with a concealable unpacking cutter movably fastened therewith such that a blade of said unpacking cutter is jutted out of said base body at the time when said unpacking cutter is in a standby position to engage in the unpacking of a package, whereby said blade of said unpacking cutter is concealed by said base body at the time when said dispensing cutter is in operation.

2. The dispenser as defined in claim 1 further comprising:

a cover mounted on an outer end of said base body such that said cover and said base body form therebetween a receiving cell having an exit, said cover provided with a hole having two stop portions, two locating portions and a passage smaller in longitudinal width than said locating portions;

an unpacking cutter mount slidably disposed in said receiving cell and provided with a through hole corresponding to said hole of said cover;

a control member comprising a rod body and a press knob, said rod body having a large diametrical portion and a small diametrical portion, said large diametrical portion having a diameter greater than the longitudinal width of said locating portions, said small diametrical portion having a diameter smaller than the longitudinal width of said locating portions, said rod body being slidably disposed in said through hole of said unpacking cutter mount and said hole of said cover, said press knob being disposed at an outer end of said rod body; and an elastic member urging at one end thereof said control member such that said large diametrical portion of said rod body is put through said locating portions at the time when said press knob is not exerted on by an external force, and that said small diametrical portion of said rod body is put through said hole of said cover at the time when said press knob is exerted on by an external force, thereby causing said control member to force said unpacking cutter mount to slide along said hole of said cover such that a blade of said unpacking cutter is jutted out of said receiving cell to be in a standby position at such time when said rod body is located at a front end of said hole of said cover whereby said blade of said unpacking cutter is retracted into said receiving cell at the time when said rod body is located at a rear end of said hole of said cover.

3. The dispenser as defined in claim 2 further comprising a slide seat which is provided with a cavity and a through hole and is disposed between said cover and said press knob such that an inner side of said slide seat is in contact with said cover, and that said rod body is put through said through hole, and further that said press knob is received in said cavity, and further that said elastic member is disposed in said cavity and fitted over said control member, with an inner end of said elastic member urging said slide seat, and with an outer end of said elastic member urging said press knob.

4. The dispenser as defined in claim 2, wherein said cutter mount is provided with a cutter slot having a through hole extending to the inside of said cutter mount, said cutter mount further provided with a nut slot corresponding in location to said through hole and having a nut; wherein said cutter is fastened in said cutter slot by a bolt which is engaged with said nut via said through hole and a round hole of said cutter.

5. The dispenser as defined in claim 4, wherein said cover has an opening corresponding in location to said bolt.

6. The dispenser as defined in claim 4, wherein said cutter has two blades; wherein said round hole is located at the center of said cutter.

7. The dispenser as defined in claim 2, wherein said through hole of said cutter mount has an inner wall and is provided in the inner wall with a shoulder facing said base body; wherein said large diametrical portion of said rod body is provided in the periphery with a protruded edge pressing against said shoulder.

8. The dispenser as defined in claim 2, wherein said through hole of said cutter mount has an inner wall and is provided in the inner wall with a predetermined number of axially-oriented grooves; wherein said large diametrical portion is provided in the periphery with a predetermined number of axially-oriented ribs whereby said ribs are inserted into said grooves.

9. The dispenser as defined in claim 2, wherein said base body is provided at the outer end with a slide slot; wherein said cover is provided with two cross plates; wherein said cutter mount is provided with a pillar whereby said pillar is inserted into said slide slot such that two side edges of said cutter mount are held by said two cross plates.

10. The dispenser as defined in claim 2, wherein said rod body is provided with an axially-oriented threaded hole; wherein said press knob is provided with a sleeve and a fisheye hole in communication with said sleeve whereby said sleeve is fastened with said rod body by a screw which is received in said fisheye hole and said threaded hole.

11. The dispenser as defined in claim 2, wherein said cover is provided with an insertion slot; wherein said base body is provided with an insertion strip which is inserted into said insertion slot.

12. The dispenser as defined in claim 2, wherein said locating portions of said hole of said cover are of a round construction and greater in diameter than said large diametrical portion of said rod body.

* * * * *